US008662255B2

(12) United States Patent
Flynn et al.

(10) Patent No.: US 8,662,255 B2
(45) Date of Patent: Mar. 4, 2014

(54) METHOD AND SYSTEM FOR HANDLING PASSENGER REQUESTS DURING AN ELEVATOR SYSTEM MODERNIZATION

(75) Inventors: Michael P. Flynn, Avon, CT (US); Allen Patenaude, Torrington, CT (US); Jannah A. Stanley, Portland, CT (US); Daniel S. Williams, Southington, CT (US)

(73) Assignee: Otis Elevator Company, Farmington, CT (US)

( * ) Notice: Subject to any disclaimer, the term of this patent is extended or adjusted under 35 U.S.C. 154(b) by 339 days.

(21) Appl. No.: 13/055,763

(22) PCT Filed: Sep. 15, 2008

(86) PCT No.: PCT/US2008/076371

§ 371 (c)(1),
(2), (4) Date: Jan. 25, 2011

(87) PCT Pub. No.: WO2010/030289

PCT Pub. Date: Mar. 18, 2010

(65) Prior Publication Data

US 2011/0120813 A1 May 26, 2011

(51) Int. Cl.
*B66B 1/28* (2006.01)

(52) U.S. Cl.
USPC ..... 187/247; 187/380; 187/391

(58) Field of Classification Search
USPC ..... 187/247, 248, 380–388, 391–393
See application file for complete search history.

(56) References Cited

U.S. PATENT DOCUMENTS

| | | | | | |
|---|---|---|---|---|---|
| 4,844,204 | A * | 7/1989 | Ovaska et al. | ..... | 187/247 |
| 5,357,064 | A * | 10/1994 | Boyce et al. | ..... | 187/247 |
| 5,389,748 | A * | 2/1995 | Burke et al. | ..... | 187/247 |
| 6,062,343 | A * | 5/2000 | Wang | ..... | 187/247 |
| 6,892,861 | B2 * | 5/2005 | Friedli | ..... | 187/247 |

(Continued)

FOREIGN PATENT DOCUMENTS

| | | | |
|---|---|---|---|
| EP | 1935824 | A1 | 6/2008 |
| JP | 5781071 | | 5/1982 |
| JP | 04266368 | | 9/1992 |
| JP | 2006264844 | A | 10/2006 |
| JP | 2008143662 | A | 6/2008 |
| WO | 2008051217 | A1 | 5/2008 |

OTHER PUBLICATIONS

International Preliminary Report on Patentability for International application No. PCT/US2008/076371 mailed Mar. 24, 2011.

(Continued)

*Primary Examiner* — Anthony Salata
(74) *Attorney, Agent, or Firm* — Carlson, Gaskey & Olds

(57) ABSTRACT

An exemplary method for handling passenger requests during elevator system modernization includes modernizing elevator cars over time. The modernized elevator cars are capable of servicing destination requests placed outside of an elevator car and include an indication of a desired destination. The exemplary method includes assigning an elevator car to respond to a new pending destination request according to a selected criterion for selecting between a modernized elevator car and an elevator car that has not yet been modernized. The method includes automatically updating the selected criterion responsive to a change in a number of modernized elevator cars. A percentage of the elevator cars that are not yet modernized are reserved and new pending requests are assigned to a modernized elevator car if a percentage of modernized cars plus the reserved percentage is greater than a current percentage of pending requests assigned to modernized elevator cars.

16 Claims, 2 Drawing Sheets

(56) References Cited

U.S. PATENT DOCUMENTS

| | | | | |
|---|---|---|---|---|
| 6,935,465 | B2 * | 8/2005 | Friedli | 187/247 |
| 7,900,750 | B2 * | 3/2011 | Mattsson et al. | 187/247 |
| 7,918,318 | B2 * | 4/2011 | Friedli et al. | 187/247 |
| 8,172,043 | B2 * | 5/2012 | Hughes et al. | 187/382 |
| 2008/0283342 | A1 * | 11/2008 | Deplazes et al. | 187/391 |
| 2011/0147134 | A1 * | 6/2011 | Flynn et al. | 187/382 |
| 2011/0308891 | A1 * | 12/2011 | Friedli | 187/247 |

OTHER PUBLICATIONS

International Search Report and Written Opinion of the International Searching Authority for International application No. PCT/US2008/076371 mailed Jun. 10, 2009.

Search Report for Chinese Application No. 200880131111.9 dated Mar. 15, 2013.

* cited by examiner

METHOD AND SYSTEM FOR HANDLING PASSENGER REQUESTS DURING AN ELEVATOR SYSTEM MODERNIZATION

BACKGROUND

Elevator systems traditionally facilitate passenger requests made by activating a hall call fixture. For example, a passenger at a particular floor can press an up or down button to indicate a desire to be carried to a different level within a building. An elevator controller recognizes the hall call placed in such a manner and assigns an elevator car to arrive at the corresponding landing to pick up the passenger. Upon entering the elevator car, the passenger uses a car operating panel to provide an indication of the floor to which the passenger desires to be carried.

It is also known to control an elevator system based upon destination entry requests from passengers. A difference between a destination entry request and a hall call is that the passenger provides an indication of their desired destination prior to entering the elevator car. There are various known destination entry systems and associated control techniques.

In some cases it is desirable to modernize or upgrade an existing elevator system that operates based upon passenger requests made at hall call fixtures so that the elevator system can operate based upon destination entry requests. To modernize or update such an elevator system, destination entry devices and appropriate controllers must be installed at appropriate locations within a building. It is desirable to minimize the amount of inconvenience to elevator passengers and building owners during a modernization process. To accomplish that goal, it is necessary to have a strategy for handling different types of passenger requests for service in the event that hall call fixtures and destination entry devices are both operational in association with the same elevator system.

SUMMARY

An exemplary method is useful for handling passenger requests during an elevator system modernization that includes modernizing elevator cars over time. The modernized elevator cars are capable of servicing destination requests placed outside of an elevator car. Such destination requests include an indication of a desired destination. The exemplary method includes assigning an elevator car to respond to a new pending destination request according to a selected criterion for selecting between a modernized elevator car and an elevator car that has not yet been modernized. The method includes automatically updating the selected criterion responsive to a change in a number of modernized elevator cars.

An exemplary elevator system includes a plurality of elevator cars. At least one of the elevator cars has not yet been modernized. At least one of the elevator cars is modernized and is capable of servicing a destination request placed outside of the elevator cars. The destination request provides an indication of a desired destination. The system includes a controller that is configured to assign one of the elevator cars to respond to a new pending destination request according to a selected criterion for selecting between a modernized elevator car and an elevator car that has not yet been modernized. The controller is configured to automatically update the selected criterion responsive to a change in a number of modernized elevator cars.

In one example, the selected criterion comprises a percentage of pending requests assigned to modernized elevator cars.

The various features and advantages of the disclosed examples will become apparent to those skilled in the art from the following detailed description. The drawings that accompany the detailed description can be briefly described as follows.

DETAILED DESCRIPTION

Figure 1:
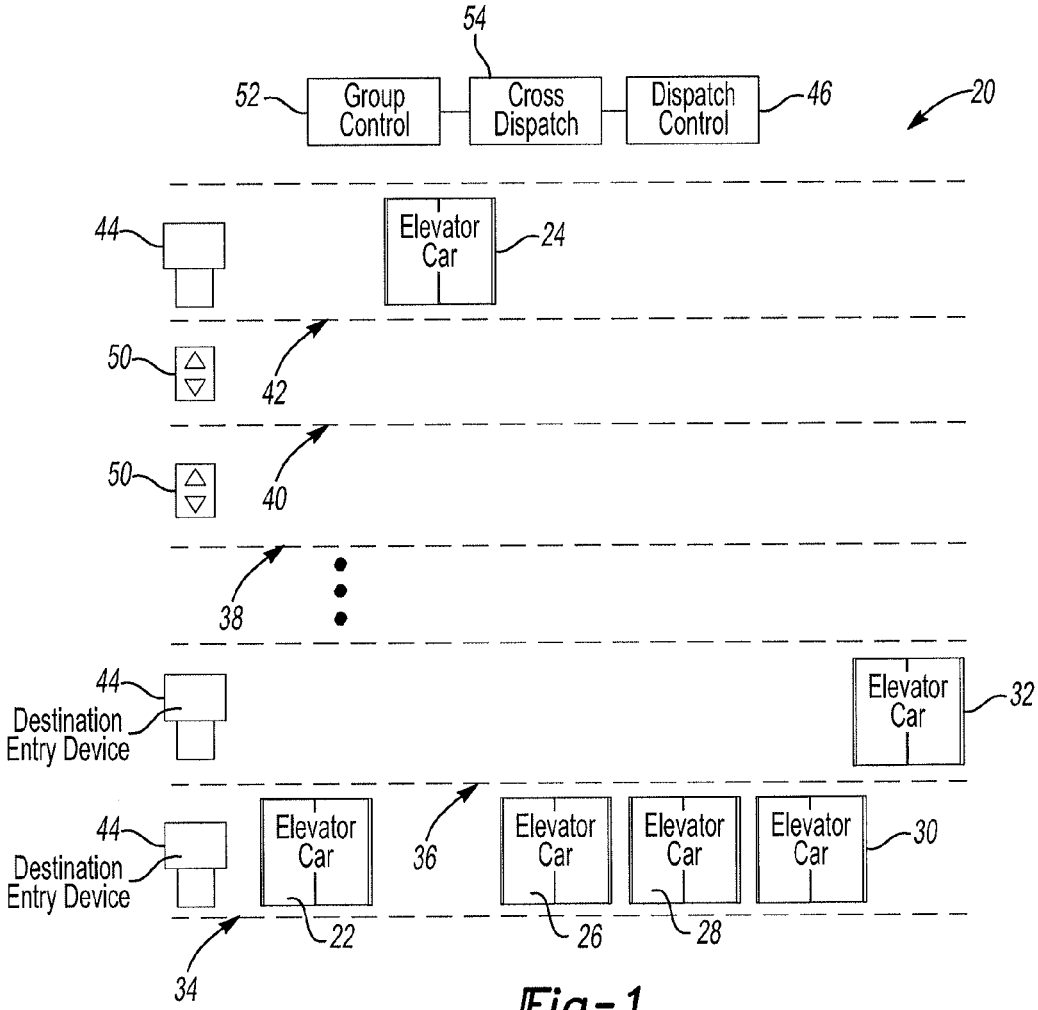
FIG. 1 schematically illustrates selected portions of an example elevator system.

FIG. 1 schematically shows selected portions of an elevator system 20. A plurality of elevator cars 22, 24, 26, 28, 30 and 32 are arranged to provide elevator service on a plurality of building levels including the example levels 34, 36, 38, 40 and 42.

The example elevator system 20 is currently undergoing a modernization process. The elevator system had been originally designed to operate responsive to hall call requests from passengers that are made by activating a hall call fixture. For example, pressing an up or down button on a particular building level provides an indication that a passenger desires to be carried from that building level and provides an indication of the intended direction of travel. Upon entering an elevator car, the passenger makes a selection on the car operating panel to indicate the desired destination.

The modernization process is for updating the elevator system 20 to make it capable of responding to destination entry requests that provide an indication of a passenger's desired destination. Destination entry requests are made outside of an elevator car. The passenger need not use a car operating panel to provide an indication of the desired destination floor as was required in a traditional elevator system that utilized hall call devices to initiate a passenger request for service.

In the example of FIG. 1, several of the building levels now include destination entry devices 44 that allow a passenger to place a destination entry request for service. The destination entry devices 44 include an appropriate user interface that allows the user to enter an indication of the desired destination before the passenger enters any one of the elevator cars. The example of FIG. 1 includes a destination entry dispatch controller 46 that responds to destination entry requests placed at one of the destination entry devices 44. When a destination request is placed, the dispatch controller 46 determines whether to assign that request to a modernized elevator car that is capable of servicing a destination entry request or to an elevator car that has not yet been modernized and is still only capable of responding to a hall call request.

In the example of FIG. 1, the elevator cars 30 and 32 have already been modernized and have associated controllers (not illustrated) in communication with the dispatch controller 46 so that either of the cars 30 or 32 are currently capable of responding to a destination entry request and being assigned to service such a request by the dispatch controller 46. The elevator cars 22, 24 and 26 have not yet been modernized and they are only capable of responding to a hall call request.

The example of FIG. 1 includes hall call fixtures 50 still in operation on some of the building levels. A group controller 52 responds to hall call requests placed at one of the hall call fixtures 50 for purposes of assigning one of the elevator cars that has not yet been modernized to service such a request.

Figure 2:
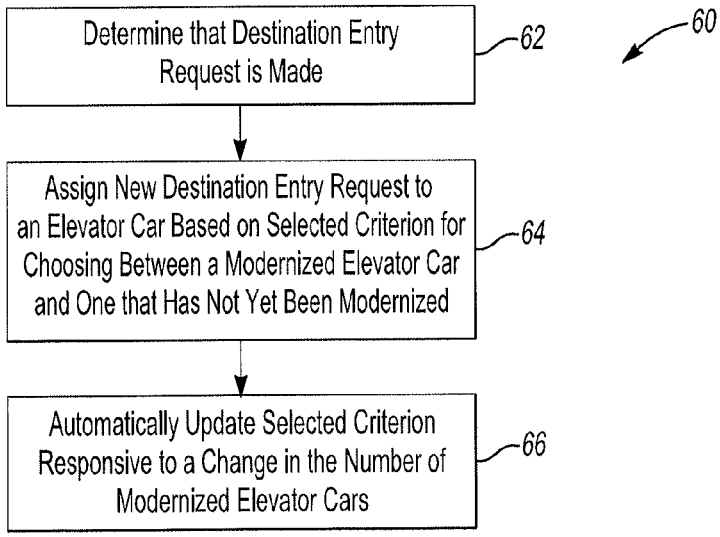
FIG. 2 is a flowchart diagram summarizing one example approach.

Providing passengers the most efficient elevator service is desirable during a modernization process. In this example, the dispatch controller 46 is configured to make an assignment of a destination request in a manner that facilitates a desired efficiency of passenger service. FIG. 2 includes a flowchart diagram 60 summarizing one example approach. At 62, the dispatch controller 46 determines that a destination entry request has been made. At 64, an assignment of one of the elevator cars to respond to the new destination request is made according to a selected criterion for selecting between a modernized elevator car and an elevator car that has not yet been modernized. At 66, the selected criterion is automatically updated responsive to a change in the number of modernized elevator cars.

For example, the elevator car 28 becomes modernized at a time subsequent to the modernization of the cars 30 and 32. The dispatch controller 46 in this example uses a different criterion or a different value of a criterion for selecting between assigning a new pending destination request to either a modernized elevator car or one of the elevator cars that has not yet been modernized after the car 28 is fully modernized. By automatically updating the selected criterion, this example provides the ability to adjust car assignments and how they are balanced between modernized elevator cars and those that have not yet been modernized. With the automatic updating feature of this example, an installer handling the modernization does not need to manually update any parameters utilized by the dispatch controller 46 as more of the elevator cars are modernized.

This example facilitates continuously achieving a desired level of passenger service efficiency even though the modernized status of different elevator cars of the system changes over time. As can be appreciated by those skilled in the art, modernizing an elevator system will often include modernizing the system on a car-by-car basis instead of modernizing the entire system all at once. When the modernization occurs over time with some cars being modernized and functional while others are not yet modernized but still functional, the disclosed example facilitates handling passenger requests in an efficient manner.

The example of FIG. 1 includes a cross dispatcher 54 that is used for communicating an indication of a hall call request to the group controller 52 even though the initial request was a destination entry request placed at one of the devices 44. The cross dispatcher 54 provides an indication of the floor at which the request was made and an indication of the desired direction of travel to allow the group controller 52 to make an assignment of one of the elevator cars that has not yet been modernized to service that request. The cross dispatcher 54, the controller 46 or both include hardware, software or both for converting a destination entry request into an appropriate indication of a hall call request that will be useable by the controller 52.

In one example, the selected criterion used by the dispatch controller 46 for choosing between a modernized elevator car or one that has not yet been modernized is a percentage of pending requests assigned to modernized elevator cars. In one example, as the percentage of modernized elevator cars increases, the desired or acceptable percentage of pending requests assigned to modernized elevator cars also increases. By automatically updating the percentage to assign to modernized cars based upon a current number of modernized cars, this example allows for adapting how car assignments are made responsive to changes in the modernization status of the overall elevator system. For example, it may be desirable to increase the percentage of calls assigned to modernized elevator cars as the modernization progresses.

In one example, the dispatch controller 46 utilizes criteria that includes determining whether the cross dispatcher 54 is eligible to receive a new pending passenger request for service. In one example, the cross dispatcher 54 is eligible for such a request if there is at least one elevator car that has not yet been modernized, the cross dispatcher is operational, the source floor of the new pending request can be serviced by an elevator car that has not yet been modernized and the destination floor of the new pending request can be serviced by an elevator car that has not yet been modernized. If the cross dispatcher is not eligible, the dispatch controller 46 assigns the new pending destination request to the best available modernized elevator car. The manner in which the best available modernized car is selected in one example is according to a known dispatching algorithm used for handing destination entry requests.

In one example, the selected criterion used by the dispatch controller 46 includes one or more forced assignment conditions. In such an example, the dispatch controller 46 determines whether a forced assignment condition exists and, if so, responsively selects between a modernized elevator car or one that has not yet been modernized responsive to the corresponding condition. For example, if there is no modernized elevator car currently available, the new pending destination request is forced to be assigned to an elevator car that is not yet modernized. Accordingly, the dispatch controller 46 communicates with the cross dispatcher 54 so that the group controller 52 receives an indication of a corresponding hall call request.

Another example forced assignment condition is that the current call was previously assigned to a modernized elevator car and not yet served by the modernized elevator car and that car is still available for hall call assignments. Under this condition, the dispatch controller 46 assigns the new pending request to the best available modernized elevator car which is likely to be the car with the same call pending.

Another example forced assignment condition includes having the call previously forwarded to the cross dispatcher 54 and the call has been pending for less than a selected amount of time (e.g., 120 seconds). Under this condition, the request is assigned to an elevator car that has not yet been modernized by communicating the request to the cross dispatcher 54.

Another example forced assignment condition is when the best available modernized elevator car can reach the level at which the request was made within a selected amount of time. In one example, the selected amount of time is based upon the remaining response time for that elevator car. In another example, the selected amount of time is based upon the impact of assigning the call to this car on the other passengers assigned to the car. Under such circumstances, the call is assigned to the best available modernized elevator car.

If there are no forced assignment conditions in existence or the dispatch controller 46 does not utilize any forced assignment conditions as part of the selected criteria, one example includes attempting to keep a ratio of demand assigned to each car type approximately equal to the ratio of the car types. In one example, the percentage of requests assigned to modernized elevator cars (out of the total pending requests) corresponds as closely as possible to the percentage of currently operational modernized elevator cars (out of all elevator cars in the system).

Figure 3:
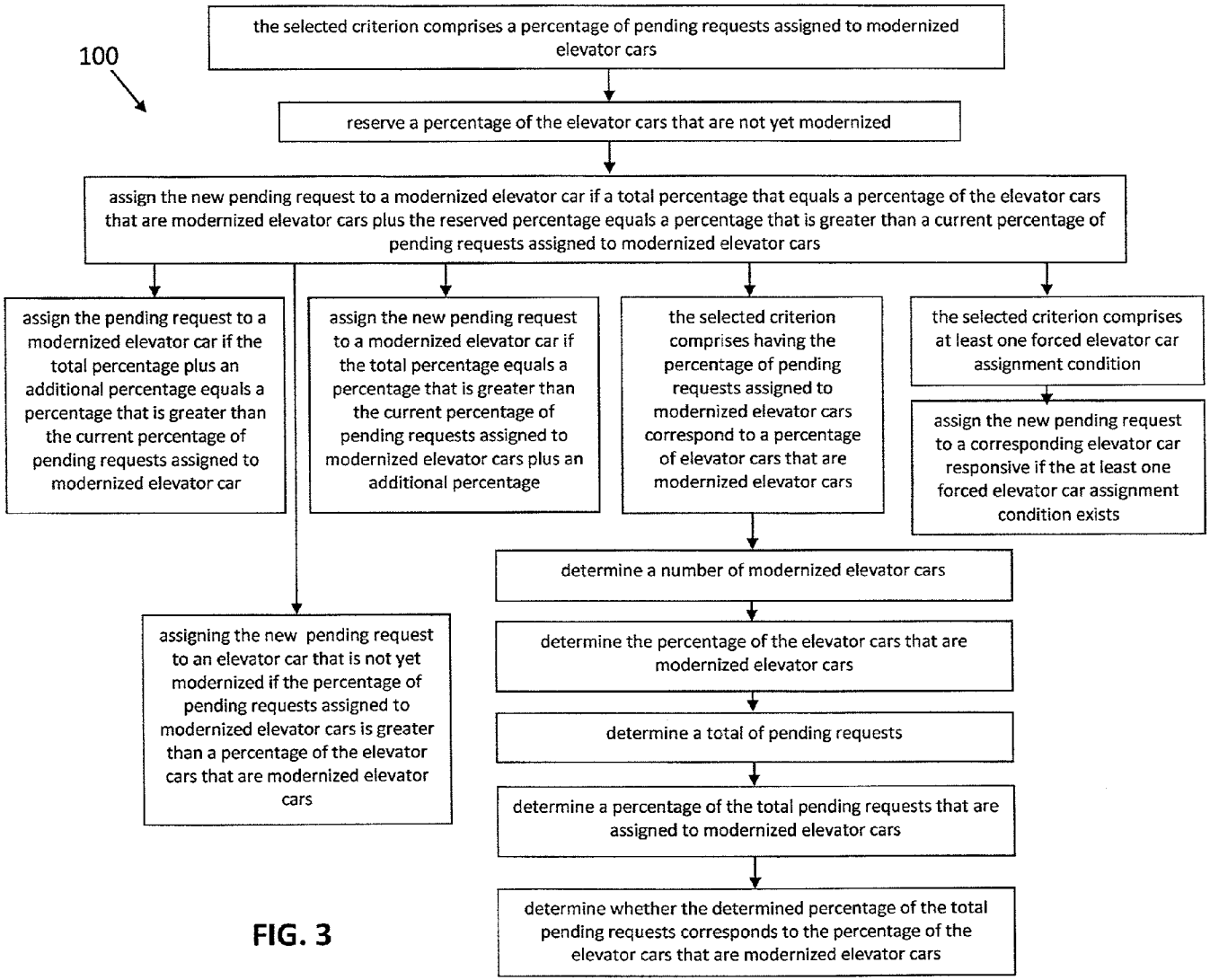
FIG. 3 is a flowchart diagram summarizing example possible features of embodiments that include the approach summarized in FIG. 2.

FIG. 3 includes a flowchart diagram 100 that summarizes a variety of ways to incorporate a percentage of assignments to modernized cars and cars that have not yet been modernized.

The following paragraphs describe various ways to incorporate such features into a strategy for handling passenger requests during a modernization process.

One example includes determining the existing demand or the current total of pending requests. The dispatch controller 46 in one example determines a number of calls placed at a destination entry device 44 assigned to an elevator car that has not yet been modernized, a number of calls placed at a hall call fixture 50 assigned to an elevator car that has not yet been modernized and a number of calls placed at a destination entry device 44 assigned to a modernized elevator car. These three determined amounts provide an indication of the total number of pending requests (i.e., the total existing demand).

In some examples, the cross dispatcher 54 will not have information regarding the number of requests made at a hall call fixture 50. In one such example, the dispatch controller 46 determines the number of such requests by determining an estimate. One example includes determining a ratio of floors having hall call fixtures 50 to the number of floors having destination entry devices 44 and multiplying a current number of requests placed at destination entry devices 44 by that ratio.

Once the total pending request amount is determined, the dispatch controller 46 determines the percentage of total requests assigned to the modernized elevator cars. Given a new pending destination request, the dispatch controller 46 determines whether adding that request to those already assigned to modernized elevators will keep the percentage of the total pending requests assigned to the modernized elevator cars within a desired range (e.g., at or below) the current percentage of the elevator cars that are modernized.

In one example, if assigning the new pending request to a modernized car will make the percentage of requests assigned to modernized elevator cars exceed the percentage of modernized elevator cars, then the dispatch controller 46 forwards the request to the cross dispatcher 54 for assignment to an elevator car that has not yet been modernized.

One example includes weighting the assignment decision factors to bias the assignments toward assigning the new pending request to a modernized elevator car. Another example biases the assignments the other way, which is toward assigning the new requests to elevator cars that have not yet been modernized. The example technique of automatically changing the selected criterion allows for changing the weighting based on how many elevator cars are already modernized. For example, it may be desirable to favor assignments to modernized elevator cars only when the percentage of them reaches a chosen threshold. At the beginning of a modernization process, there may be only one modernized elevator car and the desired quality of passenger service may more likely be consistently achieved by favoring assignments to elevator cars that are not yet modernized.

In one example an additional percentage factor is added to the percentage of modernized elevator cars to make it effectively larger. This will allow for assigning a higher percentage of requests to modernized elevator cars in an example where the selected criterion comprises having the percentage of requests correspond to the percentage of modernized elevator cars. This example favors assignments to modernized elevator cars.

Another example includes adding an additional percentage factor to the current percentage assigned to modernized elevator cars. In this example, a new pending request is assigned to a modernized elevator car if the percentage of modernized elevator cars exceeds the sum of the current percentage assigned to modernized cars and the additional percentage. This example favors assignments to elevator cars that have not been modernized.

One example accounts for calls that may be placed from a hall call fixture 50, which are not processed by or handled by the dispatch controller 46. This example includes reserving an amount (such as a percentage) of the elevator cars that have not yet been modernized. The reserved amount keeps at least one such elevator car available to respond to a possible call placed at a hall call fixture 50 while other requests are currently pending. In one example, the dispatch controller adaptively determines the number of elevator cars to reserve by determining the number of floors having active hall call fixtures 50 at which there is no current demand for service divided by the total number of floors serviced by the elevator system 20 multiplied by the total number of pending requests divided by the total number of floors serviced by the elevator system.

When there are reserved elevator cars, the percentage of reserved calls (out of the total number of cars) is added to the percentage of modernized elevator cars. The decision whether to assign a new destination request to a modernized elevator car includes determining whether that total corresponds to the percentage assigned to modernized elevator cars. For example, if the percentage of modernized elevator cars plus the percentage of reserved cars is greater than the percentage of requests assigned to modernized elevator cars, then the new request will be assigned to a modernized elevator car.

One example includes incorporating a reserved car percentage and the additional percentage factor into the determination regarding which type of car will be assigned the new request. For example, if the percentage of modernized elevator cars plus the percentage of reserved cars plus the additional percentage is greater than the percentage of pending requests assigned to modernized elevator cars, then the new request will be assigned to a modernized elevator car. Alternatively, if the percentage of modernized elevator cars plus the percentage of reserved cars is greater than the percentage of pending requests assigned to modernized elevator cars plus the additional percentage, then the new request will be assigned to a modernized elevator car.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of handling passenger requests during an elevator system modernization that includes modernizing elevator cars over time such that the modernized elevator cars are capable of servicing destination requests placed outside of an elevator car that include an indication of a desired destination, the method comprising the steps of:

assigning an elevator car to respond to a new pending destination request according to a selected criterion for selecting between a modernized elevator car and an elevator car that has not yet been modernized wherein the selected criterion comprises a percentage of pending requests assigned to modernized elevator cars;

automatically updating the selected criterion responsive to a change in a number of modernized elevator cars;

reserving a percentage of the elevator cars that are not yet modernized; and assigning the new pending request to a modernized elevator car if a percentage of the elevator cars that are modernized elevator cars plus the reserved percentage equals a percentage that is greater than a current percentage of pending requests assigned to modernized elevator cars.

2. The method of claim 1, comprising assigning the pending request to a modernized elevator car if the percentage of the elevator cars that are modernized elevator cars plus the reserved percentage plus an additional percentage equals a percentage that is greater than the current percentage of pending requests assigned to modernized elevator cars.

3. The method of claim 1, comprising assigning the new pending request to a modernized elevator car if the percentage of the elevator cars that are modernized elevator cars plus the reserved percentage equals a percentage that is greater than the current percentage of pending requests assigned to modernized elevator cars plus an additional percentage.

4. The method of claim 1, wherein the selected criterion comprises having the percentage of pending requests assigned to modernized elevator cars correspond to a percentage of elevator cars that are modernized elevator cars.

5. The method of claim 4, comprising determining a number of modernized elevator cars;

determining the percentage of the elevator cars that are modernized elevator cars;

determining a total of pending requests;

determining a percentage of the total pending requests that are assigned to modernized elevator cars; and determining whether the determined percentage of the total pending requests corresponds to the percentage of the elevator cars that are modernized elevator cars.

6. The method of claim 1, comprising assigning the new pending request to an elevator car that is not yet modernized if the percentage of pending requests assigned to modernized elevator cars is greater than a percentage of the elevator cars that are modernized elevator cars.

7. The method of claim 1, wherein the elevator system includes a cross dispatcher that converts a destination request to a hall call request to be handled by an elevator car that is not yet modernized, the selected criterion comprises the cross dispatcher being eligible to receive the new pending destination request and the method comprises determining whether the cross dispatcher is eligible to receive the new pending destination request by determining (i) that there is at least one elevator car that has not yet been modernized, (ii) that the source floor of the new pending request can be serviced by an elevator car that has not yet been modernized, and (iii) that the destination floor of the new pending request can be serviced by an elevator car that has not yet been modernized; and assigning the new pending request to a modernized elevator car if the cross dispatcher is not eligible.

8. The method of claim 1, wherein the selected criterion comprises at least one forced elevator car assignment condition and the method comprises assigning the new pending request to a corresponding elevator car responsive to determining that the at least one forced elevator car assignment condition exists.

9. An elevator system, comprising:

a plurality of elevator cars that includes at least one elevator car that has not yet been modernized and at least one modernized elevator car capable of servicing a destination request placed outside of the elevator cars, the destination request provides an indication of a desired destination; and a controller that is configured to assign one of the elevator cars to respond to a new pending destination request according to a selected criterion for selecting between a modernized elevator car and an elevator car that has not yet been modernized, the selected criterion comprising a percentage of pending requests assigned to modernized elevator cars, automatically update the selected criterion responsive to a change in a number of modernized elevator cars;

reserve a percentage of the elevator cars that are not yet modernized; and assign the new pending request to a modernized elevator car if a percentage of the elevator cars that are modernized elevator cars plus the reserved percentage equals a percentage that is greater than a current percentage of pending requests assigned to modernized elevator cars.

10. The system of claim 9, wherein the controller is configured to assign the new pending request to a modernized elevator car if the percentage of the elevator cars that are modernized elevator cars plus the reserved percentage plus an additional percentage equals a percentage that is greater than a current percentage of pending requests assigned to modernized elevator cars.

11. The system of claim 9, wherein the controller is configured to assign the new pending request to a modernized elevator car if the percentage of the elevator cars that are modernized elevator cars plus the reserved percentage equals a percentage that is greater than the current percentage of pending requests assigned to modernized elevator cars plus an additional percentage.

12. The system of claim 9, wherein the selected criterion comprises having the percentage of pending requests assigned to modernized elevator cars correspond to a percentage of elevator cars that are modernized elevator cars.

13. The system of claim 12, wherein the controller is configured to determine a number of modernized elevator cars;

determine the percentage of the elevator cars that are modernized elevator cars;

determine a total of pending requests;

determine a percentage of the total pending requests that are assigned to modernized elevator cars; and determine whether the determined percentage of the total pending requests corresponds to the percentage of the elevator cars that are modernized elevator cars.

14. The system of claim 9, wherein the controller is configured to assign the new pending request to an elevator car that is not yet modernized if the percentage of pending requests assigned to modernized elevator cars is greater than a percentage of the elevator cars that are modernized elevator cars.

15. The system of claim 9, comprising a cross dispatcher configured to convert a destination request to a hall call request to be handled by an elevator car that is not yet modernized, wherein the selected criterion comprises the cross dispatcher being eligible to receive the new pending destination request and the controller is configured to determine whether the cross dispatcher is eligible to receive the new pending destination request by determining (i) that there is at least one elevator car that has not yet been modernized, (ii) that the source floor of the new pending request can be serviced by an elevator car that has not yet been modernized, and (iii) that the destination floor of the new pending request can be serviced by an elevator car that has not yet been modernized; and wherein the controller is configured to assign the new pending request to a modernized elevator car if the cross dispatcher is not eligible.

16. The system of claim 9, wherein the selected criterion comprises at least one forced elevator car assignment condition and the controller is configured to assign the new pending request to a corresponding elevator car responsive to determining that the at least one forced elevator car assignment condition exists.

* * * * *